United States Patent [19]

Shotbolt

[11] Patent Number: 4,470,721

[45] Date of Patent: Sep. 11, 1984

[54] CRANE ASSEMBLY FOR FLOATABLE OIL/GAS PRODUCTION PLATFORMS

[75] Inventor: Keith Shotbolt, Gerrards Cross, England

[73] Assignee: John Brown Engineers and Constructors Ltd., London, England

[21] Appl. No.: 310,294

[22] Filed: Oct. 9, 1981

[30] Foreign Application Priority Data

Oct. 10, 1980 [GB] United Kingdom ..... 8032783
Oct. 16, 1980 [GB] United Kingdom ..... 8033314
Sep. 25, 1981 [GB] United Kingdom ..... 8129116

[51] Int. Cl.[3] ..... B63B 35/44; E02B 17/00

[52] U.S. Cl. ..... 405/195; 212/190; 114/264

[58] Field of Search ..... 405/195, 201; 114/264, 114/265; 166/350, 352, 355, 359, 366, 367, 79; 175/5, 7; 212/190, 205, 270; 414/745

[56] References Cited

U.S. PATENT DOCUMENTS 3,817,412 6/1974 Mercier et al. ..... 212/190 X
4,090,368 5/1978 Bell et al. ..... 405/201
4,108,318 8/1978 Rode et al. ..... 212/190 X
4,135,841 1/1979 Watkins ..... 175/7 X
4,215,950 8/1980 Stevenson ..... 405/195
4,234,269 11/1980 Person et al. ..... 405/195
4,351,261 9/1982 Shanks ..... 175/5 X

FOREIGN PATENT DOCUMENTS 2023205 12/1979 United Kingdom ..... 166/367

*Primary Examiner*—David H. Corbin
*Attorney, Agent, or Firm*—Bacon & Thomas

[57] ABSTRACT

A floatable oil/gas production platform assembly has a deck, disposed beneath the deck a zone including a plurality of adjacent stations for support of oil/gas flowlines/risers originating from beneath the platform, and a crane disposed in a space above the station zone but below the deck and moveable over at least some of the stations.

Such an assembly enables two new alternative equipment arrangements to be provided in floating platforms for tensioning and supporting underwater well maintenance lines or "workover risers" which require considerable tensioning forces and stroke capacity for safe support.

15 Claims, 5 Drawing Figures

1
2
2
3
4
5
6
7
8
11
33
33
34

CRANE ASSEMBLY FOR FLOATABLE OIL/GAS PRODUCTION PLATFORMS

BACKGROUND TO THE INVENTION

In the exploitation of under sea hydrocarbon reserves, production platforms have usually been fixed structures which were piled to or rest firmly on the seabed. Fixed structures are very expensive in deep water, too expensive for small shallow water fields with short productive lives, and are difficult to remove once a field is depleted. Accordingly, floating platforms have been developed and two fields producing hydrocarbons in September 1980 have floating production systems installed. The first such system began producing oil from the Argyll field in 1975 and uses a semi-submersible rig, "Transworld 58", to process oil flowing from four scattered appraisal wells. Flow lines are connected to a single manifold under the rig and continue upwards through individual lines of a composite flow line or riser. The second such floating system began producing oil in 1980, and uses a semi-submersible rig, "Sedco I" to process oil flowing from three wells drilled on the seabed directionally from a cluster directly beneath the rig. Each of the three wells has an individual hydrocarbon flowline or riser from its subsea master valve block to the platform. In the platform there is an area termed the "moonpool" area containing the stations where the risers are received in the platform. An arrangement such as this latter arrangement offers the advantages of relatively vertical flow paths for fluids produced from subsea wells, simpler subsea equipment, and direct vertical access for maintenance/repair work. For these reasons, this provides the preferred method for multi-well floating hydrocarbon production systems in water depths to at least 300 meters. The "moonpool" is constituted by an opening through at least the main deck area of the platform and, in conventional construction, is provided with a roof constituted by a platform top deck which carries the derrick. It is normally the case that the area above the moonpool under the platform top deck or moonpool roof is obstructed by cables and other equipment. This present invention is based upon the appreciated that the freeing of this space and its occupation by a moveable crane provides substantial advantages in floating platform maintenance and operation.

Examples of multi-well floating production platform designs having individual hydrocarbon flowlines/risers from each well to the platform are the PRODUCAT design by Forex Neptune in the magazine Ocean Industry, October 1977, pages 53 to 56, and the Tension Leg Platform, described in Ocean Industry, February 1980, pages 35 to 39 and in paper No. 3881 presented at the Offshore Technology Conference in Houston, Tex., U.S.A. in May 1980. Floating platforms, whether anchored to the seabed by catenary or vertical lines, or dynamically positioned, are subject to marine motions which prevent the rigid support of fluid risers from the seabed. So-called riser tensioners or riser tensioning systems have therefore been developed.

Subsea wells drilled into hydrocarbon bearing formations are usually lined with a cemented steel casing and fluid produced from the well rises up concentric tubing which has a sealing packer at the lower end thereof. The tubing string may have a full-bore down-hole safety valve screwed into it, and the resulting assembly may be suspended from a tubing hanger in the subsea wellhead. A subsea valve block (sometimes called a "Christmas tree") stabs into the tubing hanger and connects to the wellhead. A flowline or riser leads from the subsea valve block to the surface and permits the conveyance of fluids produced to the process equipment. If a problem arises with the well equipment below the subsea valve block, a maintenance operation called "major workover" is required on the subsea well. This requires the use of a maintenance line or "workover riser" and for precisely the same reasons that tension needs to be applied to the individual well risers, tension must also be applied to the workover riser. Examples of problems which may be encountered requiring the "major workover" operation include tubing corrosion, sliding sleeve valve or tubing-retrievable safety-valve failure, or packer leakage. Access to the well below the subsea valve block in order to perform "major workover" is only possible from a floating production platform if a structure termed a blow-out preventer (BOP) stack is built into the floating platform in addition to the workover riser, a riser tensioning system and "kill" fluid. The BoP stack is a known assembly designed to provide control over fluid flow into and/or out of a well during drilling or workover operations when no other mechanical means (such as valves) are available.

A floating platform may, for example, have ten risers leading from corresponding subsea wells each received in the moonpool area. It may, of course, be necessary to perform "major workover" on any one of these wells but it has been found that small tensioners of the type appropriate for ordinary well flowines/risers (production risers) are inadequate to support a workover riser properly. Typical production risers may be about seven inches in diameter and the appropriate riser tensioners exhibit up to 60,000 lbs pull. In contrast, the workover riser may have a minimum diameter of 16 inches with external choke and "kill" lines and may need a minimum 320,000 lbs of tension capacity to be available for safety. Thus, there is a need for tensioning systems for such workover risers.

OBJECTS OF THE INVENTION

It is a primary object of the invention to free the space above the moonpool and under the platform deck in a floating platform and to provide therein a movable crane so as to enable substantial advantages in floating platform maintenance and operation to be achieved using such crane.

It is also an object of the invention to use the above unique crane arrangement in providing one or more of at least two tensioner arrangements for maintenance lines or "workover risers".

SUMMARY OF THE INVENTION

The present invention provides a floatable oil/gas production platform assembly having a deck, disposed beneath the deck a zone including a plurality of adjacent stations for support of oil/gas flowlines/risers originating from beneath the platform, and a crane disposed in a space above the station zone but below the deck and moveable over at least some of the stations. In another aspect of the invention the crane has suspended therefrom means for applying tension to a workover riser passing through the station zone and adapted, in use, to permit maintenance to be performed upon an underwater well beneath the platform corresponding to one of the oil/gas flowlines/risers. In an alternative aspect, the crane carries a pulley arrangement through which pass tensioning cables connected at their lower ends to a workover riser passing through the station zone and adapted, in use, to permit maintenance to be performed upon an underwater well beneath the platform corresponding to one of the oil/gas flowlines/risers and at their other ends to tensioning means for applying tension to the cable and hence to the workover riser, which tensioning means is positioned in an area peripheral to the station zone.

DESCRIPTION OF THE DRAWINGS

In the accompanying drawings identical parts have identical reference numerals throughout.

DESCRIPTION OF THE PREFERRED EMBODIMENTS

Figure 1:
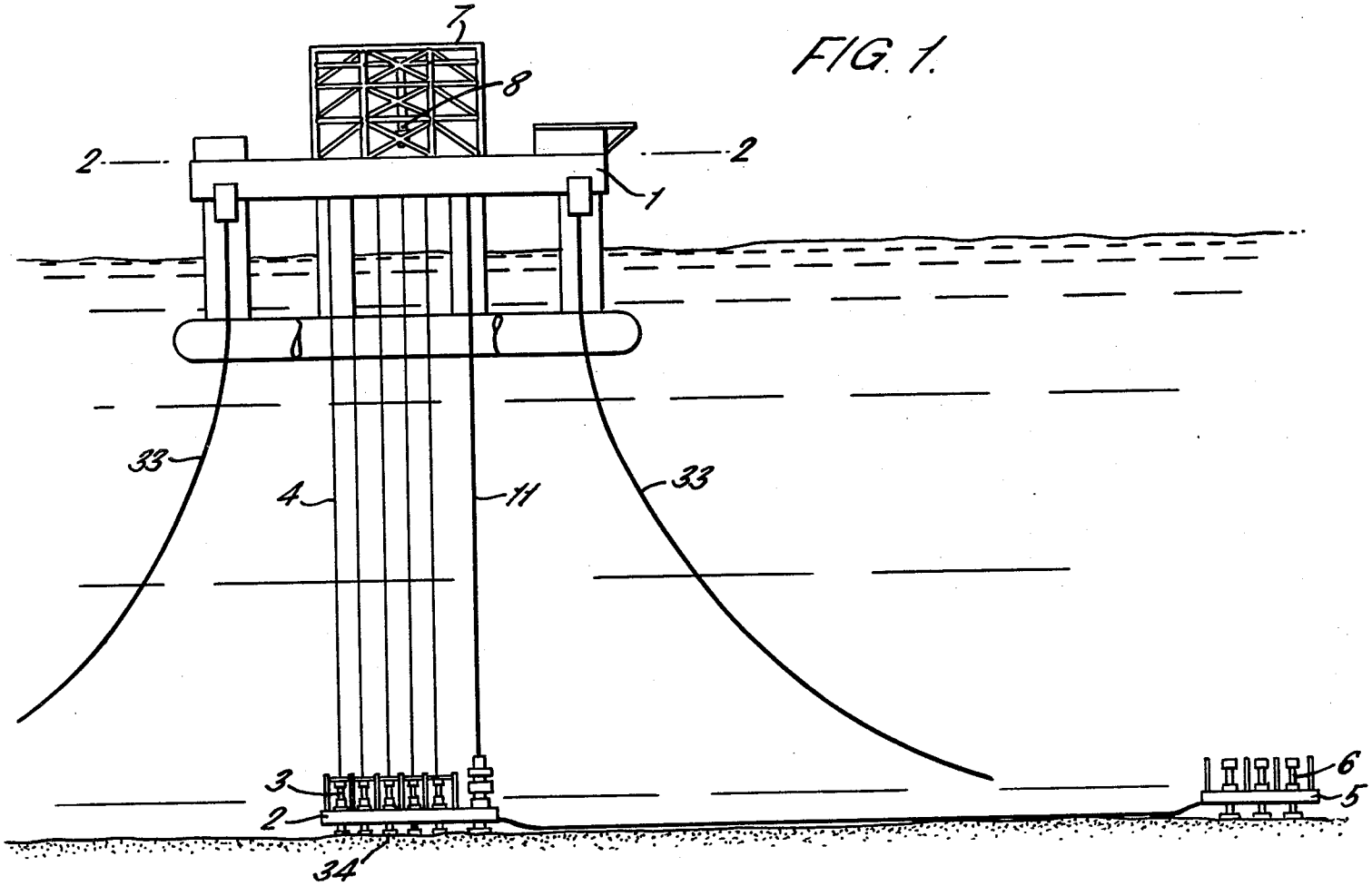
FIG. 1 is a stylised overall view of a floating hydrocarbon production platform with individual risers from subsea wells.

As shown in FIG. 1, a floating production platform generally designated 1 is anchored by anchor cables 33 directly above a subsea template 2 and individual wells 34. Above template 2 are master valves 3 from which individual flowlines or production risers 4 carry fluids produced from the well up to platform 1 which contains process equipment (not shown) for the separation of oil, gas and water. A second template 5 contains water injection wells 6. Platform 1 supports a derrick 7 which has mounted therein a travelling block with motion compensator 8 which may be suspended, at will, over each well position.

Figure 2:
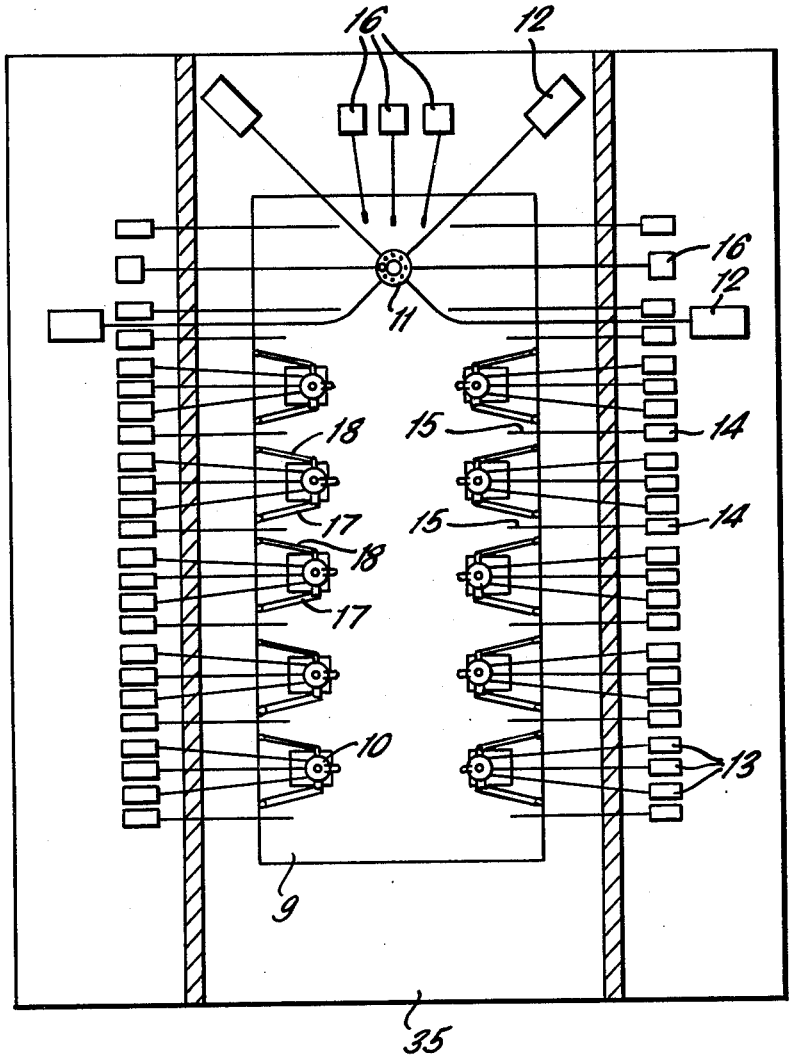
FIG. 2 is a plan view of the "moonpool" area of the platform of FIG. 1 taken along the line 2—2 in FIG. 1.

From FIG. 2 it may be seen that moonpool opening 9 in the deck structure 35 of platform 1 includes ten entirely conventional valve assemblies 10 (known as surface "trees") ranged in five pairs. One of the individual risers 4 corresponds to each of trees 10. A single multiline riser 11 for exporting oil production and for carrying injection water to injection wells 6 (see FIG. 1) is supported by four large tensioners 12 of conventional design. Three small tensioners 13 of conventional design support each surface tree 10 and riser 4 and other small tensioners 14 support guidelines 15 which may be connected, when required, for guiding equipment to and from the seabed template 2 shown in FIG. 1. Tensioners 12, 13 and 14 are well known structures and are illustrated in the "Composite Catalogue of Oilfield Equipment and Services" (1980/81) published by "World Oil". Conventional dead weight cans 16 apply tension to control system umbilicals (not shown) which transmit signals to valves 3 and wells 6 and 34 when desired. Each of trees 10 may be attached to a flexible hose 17 for carrying oil/gas from the respective flowline/riser 4 onto platform 1 and a flexible hose 18 for carrying gas (for gas lift or gas injection purposes) from platform 1 to the respective flowline/riser 4. Oil and gas connections between the platform and trees 10 must be flexible in view of the movement and heaving of platform 1 expected at sea locations.

Normal dimensions of the moonpool area may be appreciated from the fact that an ordinary separation between the centres of each of a pair of trees 10 is about fifteen feet.

Figure 3:
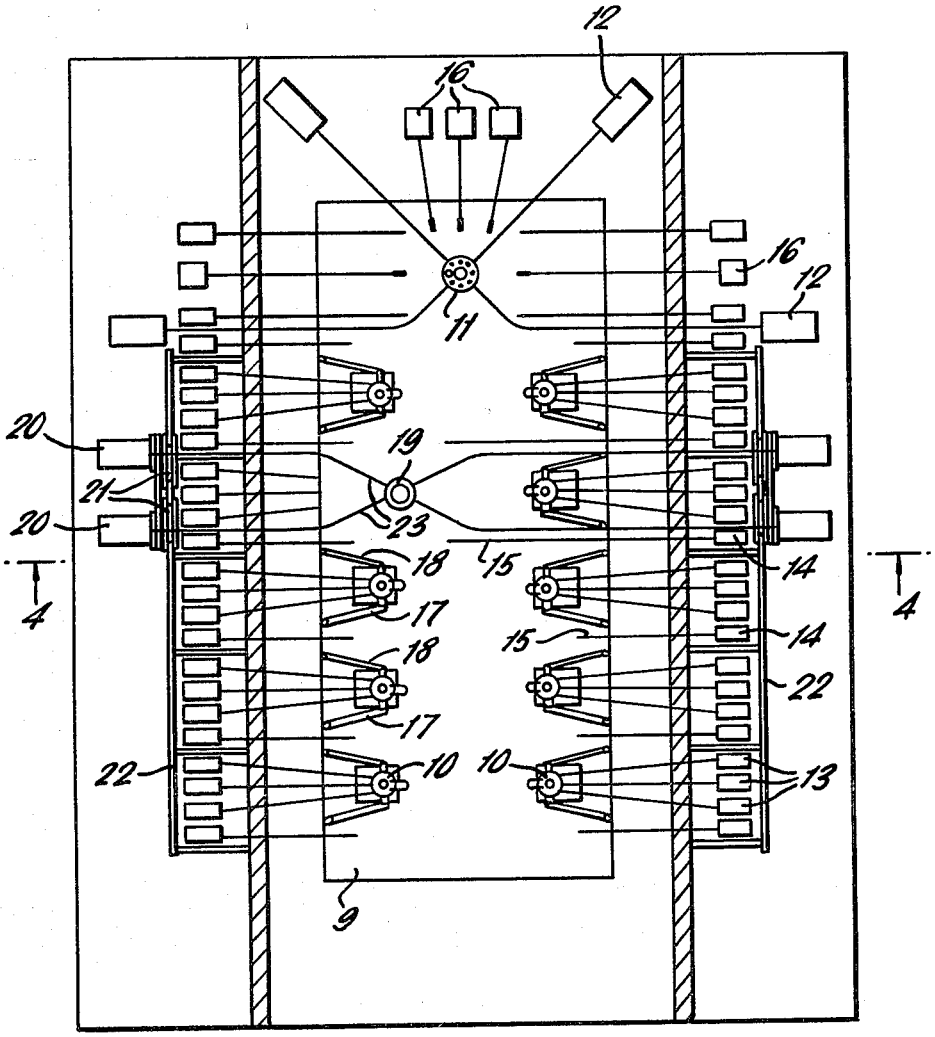
FIG. 3 is a plan view similar to FIG. 2 but showing "major workover" and a workover riser in position with tensioning in accordance with one embodiment of the invention.

Turning now to FIG. 3, one of trees 10 has been removed from the moonpool area and a workover riser 19 is in position supported by tensioning cables 23 which are connected to tensioners 20 which are of entirely conventional design known to the skilled man. (See for example, "Composite Catalogue of Oilfield Equipment and Services" (1980/81)). A pair of rails 22 is provided parallel with but peripheral to the moonpool area and tensioners 20 are mounted in a moveable fashion upon rails 22 by way of flanged wheels 21.

Figure 4:
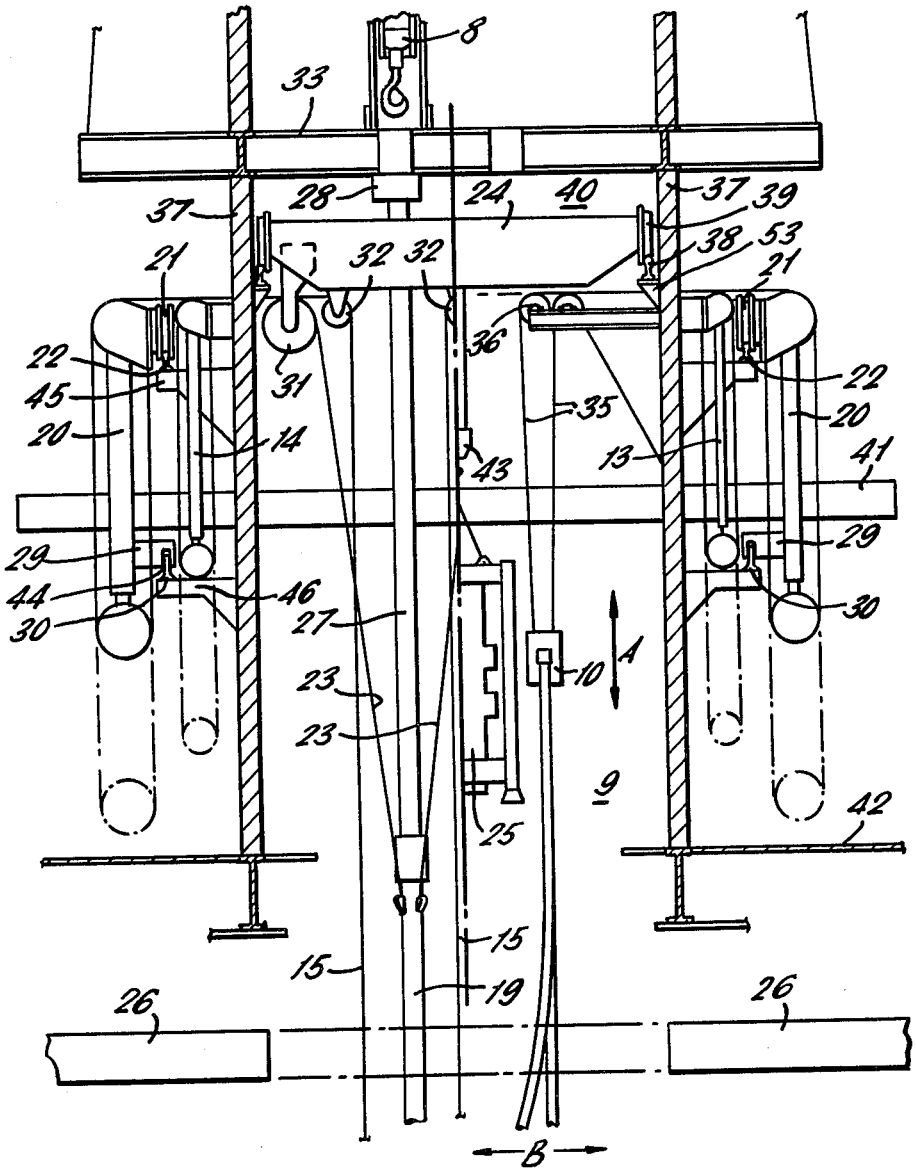
FIG. 4 is a split figure showing a section through the plan view of the "moonpool" area of the FIG. 3 along the line 4—4; the right hand side of FIG. 4 shows the equipment for normal oil/gas producing operations and the left hand side shows the equipment for performing a "major workover" of the subsea well in accordance with one embodiment of the invention.

Examining now the right hand side of FIG. 4, tree 10 is suspended by tensioning cables 35 which pass over pulley arrangement 36. Each of tensioners 13 provides tension to one of cables 35 and hence supports a tree 10 in its operating station in the moonpool area 9. A bridge crane 24 bridges across moonpool area 9 and is mounted by means of flanged wheels 39 at each end thereof on rails 38 which are in turn mounted upon shelves 53 connected to superstructure 37. In normal operation, the space 40 above the moonpool area 9 is free save only for the bridge crane 24 which can travel along the extent of moonpool area 9. Superstructure 37 passes through mezzanine deck 41 in passing from main deck 42 up to top deck 33. Retractable spider beams 26 are positioned below main deck 42.

The maximum heave of platform 1 in a force 12 gale and hence the maximum movement relative to the platform of tree 10 in the direction of arrow A in FIG. 4, may be, for example, 6.5 meters. Arrow B in FIG. 4 indicates the lateral movement of riser 4 exhibited during storm conditions.

Continuing to refer to the right hand side of FIG. 4, bridge crane 24 has suspended from its hook arrangement 43 a blow-out preventor stack (BOP) 25 of entirely conventional structure known to the skilled man. Reference may be made to the "Composite Catalogue of Oilfield Equipment and Services" (1980/81) for details of available BOP structures. Thus, BOP stack 25 may be transported by movement of bridge crane 24 between the pairs of trees 10.

Turning now to the left hand side of FIG. 4, one of trees 10 has been removed and the equipment is arranged so as to allow "major workover" on the subsea well corresponding to the removed tree 10. Prior to achieving the arrangement of equipment shown, the particular subsea master valve block 3 and riser 4 associated with removed tree 10 and the corresponding well position have been recovered, the well, of course, having been killed and plugs set. Removal of the riser 4 and master valves 3 cannot usually be effected without guide lines unless weather conditions are less severe than Beaufort Scale Force 6. The BOP stack 25 (see the left hand side of FIG. 4) may then be moved throughout the moonpool area 9 by moving bridge crane 24. BOP stack 25 passes through the "avenue" of trees 10 and may be held firmly upon spider beams 26 at the relevant well position. At the relevant well position, crane 24 may be locked in position with conventional locking pins (not shown). Pulleys 31 and 32 are then fitted to crane 24 and guide lines 15 are fitted over pulleys 32, passed through superstructure 37 and fitted to small tensioners 14. The lower ends of guide lines 15 are attached to seabed guide posts (not shown). Workover riser tensioners 20 are then moved along rails 22 by way of flanged wheels 21 into alignment with the appropriate well position, wheels 21 locked in position by a lock (not shown) of entirely conventional structure and tensioning cables 23 passed over pulleys 31 to tensioners 20. At this point, workover riser 19 is suspended from travelling block with motion compensator 8 and is lowered between the beams of crane 24 by movement of travelling block and motion compensator 8. BOP stack 25 is then transferred to workover riser 19 and placed upon the appropriate subsea well head using workover riser 19 and guide lines 15 in a conventional manner. When BOP stack 25 is connected to the particular subsea well head, tensioning cables 23 are connected at their lower ends to workover riser 19. Sufficient tension is applied via cables 23 from tensioners 20 to workover riser 19 in order to support riser 19. Then, travelling block and motion compensator 8 is released and employed in a conventional manner to assemble a telescopic joint 27 (of conventional design, see "Composite Catalogue of Oilfield Equipment and Services" (1980/81)) which is connected to the top of workover riser 19 and which terminates in upper ball joint 28 mounted immediately under top deck 33. Once travelling block and motion compensator 8 have been employed to assemble the telescopic joint 27 and upper ball joint 28 they can now be used to remove equipment such as the tubing hanger (not shown) and tubing (not shown) from the particular subsea well.

Thus, workover riser 19 is supported by tensioning cables 23 which pass over pulleys 31 to tensioners 20. Tensioners 20 are mounted on flanged wheels 21 which themselves are lockably moveable along rails 22. Tensioners 20 are prevented from excessive lateral movement or swinging by the provision from a lower portion thereof of a slotted guide 29 for each tensioner 20. Each slotted guide 29 has a slot 44 therein which straddles a rail 30 positioned below rail 22. Rails 22 and 30 are mounted on respective shelves 45 and 46 connected to superstructure 37. Telescopic joint 27 is suspended by the upper ball joint 28 mounted under top deck 33.

Figure 5:
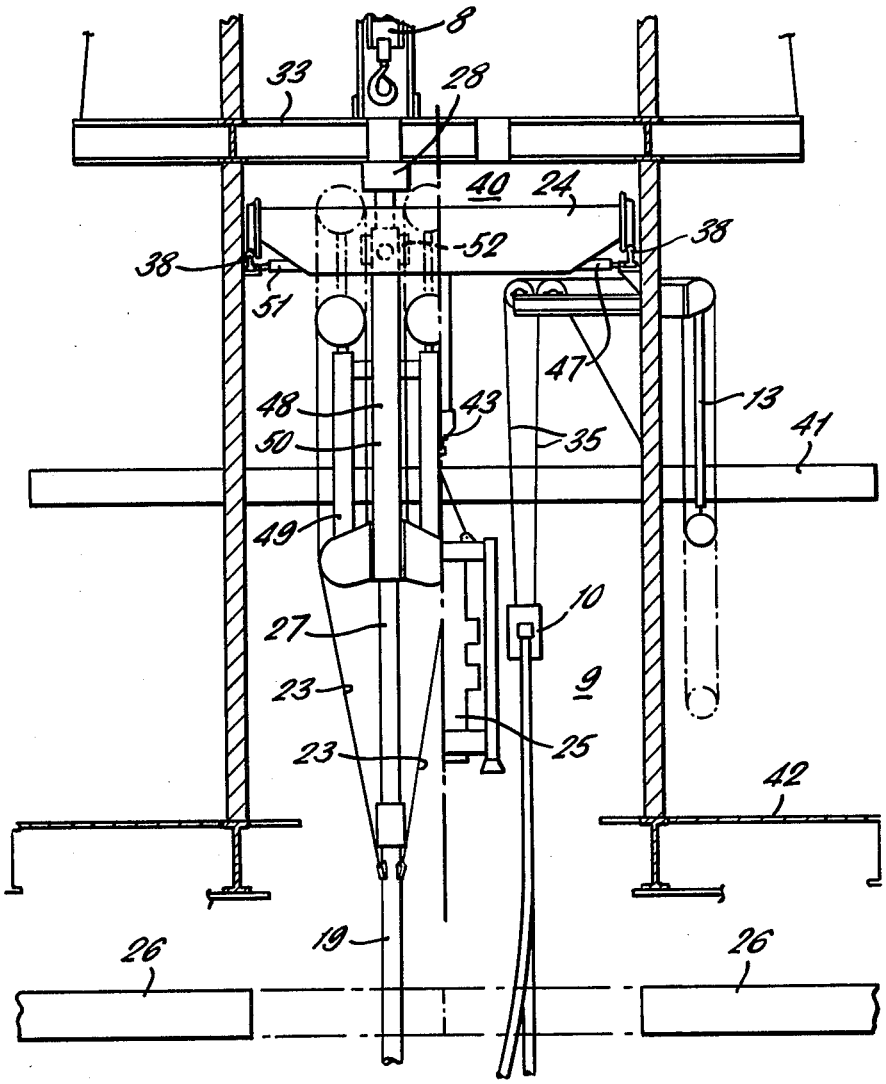
FIG. 5 is a split sectional view similar to that of FIG. 4 showing, on the right hand side, the equipment for normal oil/gas producing operations and, on the left hand side, the equipment for performing a "major workover" of a subsea well in accordance with a second embodiment of the invention.

Turning now to FIG. 5, the two halves of this figure demonstrate a second embodiment of the invention in the provision of tensioning for a workover riser. Turning first to the right hand side of FIG. 5, it will be seen that tree 10 is suspended by tensioners 13 in the normal hydrocarbon production mode with crane 24 supporting BOP stack 25. The structural arrangement is identical with that shown on the right hand side of FIG. 4 and described above. Accordingly, further description is superfluous save only to indicate that tensioners 20 (FIG. 4) are not necessary in this embodiment and therefore are not shown. Of course, in practice the skilled man will appreciate that tensioners 20 as shown in FIG. 4 may be positioned in an area peripheral to the moonpool area 9 if flexibility of tensioning systems is desired and if it may be necessary to revert from the embodiment described with reference to FIG. 5 to that already described with reference to FIG. 4.

Examining now the left hand side of FIG. 5, one of trees 10 has been removed (c.f. the left hand side of FIG. 4) and the equipment is arranged to allow "major workover" of the particular subsea well corresponding to the removed tree 10.

As with the first embodiment described with reference to FIG. 4, certain operations have to be effected prior to achieving an arrangement of equipment such as shown in the left hand side of FIG. 5.

Thus, the well has been killed, plugs set, and particular master valves 3 and riser 4 for the subsea well position in question have been recovered.

As in the embodiment shown in FIG. 4, crane 24 is used to transport BOP stack 25 through the moonpool area and BOP stack 25 may be placed upon retractable spider beams 26 in a position above the subsea well in question. Crane 24 is then released to permit its return to a different part of moonpool area 9 to pick up a workover riser tensioning system generally designated 48 and hereinafter referred to as WRTS. WRTS 48 comprises tensioners 49 arranged around a support frame 50. Tensioners 49 are of entirely conventional design and are well known to the skilled man, (see, for example, "Composite Catalogue of Oilfield Equipment and Services" (1980/81)). WRTS 48 may be transported by crane to a position over BOP stack 25 (supported on retractable spider beams 26) and locked in position using locating pins 51 which abut rails 38 to prevent longitudinal movement of crane 24 along rails 38. Workover riser 19 is picked up by travelling block with motion compensator 8 and is lowered between the beams of crane 24, and through the WRTS support frame 50, and connected to BOP stack 25. BOP stack 25 is then lifted, by means of workover riser 19 and travelling block with motion compensator 8, the spider beams 26 are retracted, and BOP stack 25 is lowered to, placed up and latched to the appropriate subsea wellhead in a conventional manner. Workover riser 19 is, at this point, suspended directly by travelling block and motion compensator 8 and is lowered by travelling block and motion compensator 8 between the beams of crane 24 into position with respect to the particular subsea well. Whilst workover riser 19 is suspended from travelling block and motion compensator 8 in this position, BOP stack 25 may, as described for the embodiment of FIG. 4, be placed on the subsea well head using workover riser 19. Tensioning cables 23 are now led from workover riser 19 to individual tensioners 49 in WRTS 48 and sufficient tension is applied to support workover riser 19. At this point, travelling block and motion compensator 8 are released and may be used to assemble a telescopic joint 27 and upper ball joint 28. With this arrangement of equipment, as for the embodiment described with reference to FIG. 4, equipment such as the tubing hanger (not shown) may be removed from the particular subsea well.

In the arrangement shown in the left hand side of FIG. 5, workover riser 19 is supported via cables 23 from tensioners 49. Tensioners 49 are arranged, preferably symmetrically, around support frame 50. Gimbals 52 which provide the connection between support frame 50 and crane 24 are located around the telescopic joint 27 and the telescopic joint is suspended by upper ball joint 28 mounted, as in the embodiment shown in FIG. 4, just beneath top deck 33. Thus, using this particular embodiment, there is no requirement for equipment external to the moonpool area 9 in providing tension to a workover riser such as workover riser 19.

It will be appreciated that the provision of a moveable crane 24 within space 40 above moonpool area 9 provides flexibility and access convenience for many operations which previously required different equipment. Conventionally, space 40 is cluttered by cables and other material. The use of a crane such as crane 24 enables, as has just been described, convenience of operation in major maintenance undertakings such as "major workover" on a subsea well. It also provides a means of facilitating adequate supporting tension to relatively massive risers such as are necessary for the performance of "major workover". It will, however, be appreciated that the present invention is not limited to travelling cranes as such provided the crane is able to move functionally over various parts of moonpool area 9.

In view of the above description it will be appreciated that the invention includes a method of facilitating the performance of maintenance or repair work on an underwater well beneath a floating oil/gas production platform, which method comprises providing a maintenance line to the well from the platform and tensioning and supporting the line by providing an assembly in accordance with either of the embodiments for providing workover riser tensioning referred to above and illustrated with reference to the drawings.

Reference can be made to "Composite Catalogue of Oilfield Equipment and Services" (1980/81) for details of standard equipment referred to herein in describing the present inventive crane arrangement.

It will be appreciated that whilst the present invention has been described and illustrated above with reference to preferred embodiments, such embodiments are illustrative and not limiting upon the scope of the invention. The skilled man will have no difficulty in devising other embodiments and in appreciating alterations, modifications and adaptations all within the spirit and scope of the invention.

I claim:

1. A floating oil/gas production platform comprising (a) a top deck;

(b) a main deck located below the top deck and defining a moonpool opening;

(c) a plurality of production flowlines/risers extending between a plurality of subsea wells and a plurality of valve assembly stations located in the moonpool opening of the main deck;

(d) a movable crane disposed above the moonpool area and below the top deck, the crane being movable along support means on opposite sides of the moonpool opening over at least some of the valve assembly stations;

(e) workover riser means associated with the platform; and, (f) workover riser locating means to locate the workover riser at at least some of the valve assembly stations.

2. A floating oil/gas production platform according to claim 17, wherein said crane is a travelling bridge crane having opposite ends having a flanged wheel located at each of said ends, wherein the support means is a pair of substantially parallel rails, each of said flanged wheels being positioned on a respective one of a pair of the substantially parallel rails, said rails defining therebetween an area over said valve assembly stations, whereby movement of said crane along said rails and over said stations is permitted.

3. A floating oil/gas production platform according to claim 2, wherein said crane is provided with locking means for locking said crane against motion along said rails.

4. A floating oil/gas production platform according to claim 1, wherein the workover riser means passes through said moonpool area and is adapted, in use, to permit maintenance to be performed on the subsea wells beneath said platform corresponding to one of said production flowlines/risers, said crane having suspended therefrom means for applying tension to said workover riser.

5. A floating oil/gas production platform according to claim 4, wherein said means for applying tension comprises a plurality of tensioning cables, each of said cables having a lower end connected to said workover riser and an upper end connected to tensioning means for applying tension to said workover riser, said tensioning means being mounted on a support frame extending from said crane.

6. A floating oil/gas production platform according to claim 5, wherein said workover riser has an upper end which is connected to a telescopic joint, said support frame being positioned around said telescopic joint.

7. A floating oil/gas production platform according to claim 6, wherein the support frame is attached to the crane by an arrangement of gimbals adapted to permit limited angular motion of said support frame in all vertical planes.

8. A floating oil/gas production platform according to claim 6, wherein said tensioning cables are symmetrically arranged around said workover riser.

9. A floating oil/gas production platform according to claim 1, wherein: the workover riser means passes through said moonpool area and is adapted, in use, to permit maintenance to be performed upon the subsea wells beneath said platform corresponding to one of said production flowlines/risers; said crane carries a plurality of pulleys over which pass a corresponding plurality of tensioning cables, each cable having a first end connected to said workover riser and second end; and tensioning means connected to the second end of the tensioning cables for applying tension to said cables and, hence, to said workover riser, said tensioning means being positioned in an area peripheral to said moonpool area.

10. A floating oil/gas production platform according to claim 9, wherein said tensioning means is moveable in said area.

11. A floating oil/gas production platform according to claim 10, wherein said tensioning means is provided with a flanged wheel mounted thereon and moveable along a rail positioned in said area.

12. A floating oil/gas production platform according to claim 11, wherein said tensioning means is also provided with a slotted guide, the slot of said guide straddling a further rail fixed in said area whereby excessive lateral movement of said tensioning means relative to said further rail is prevented.

13. A method of facilitating the performance of maintenance or repair work on an underwater well beneath a floating oil/gas production platform having a top deck, a main deck located below the top deck and defining a moonpool opening, a plurality of oil/gas production flowlines/risers extending between a plurality of underwater wells beneath said platform, and a plurality of adjacent valve assembly stations located in the moonpool area which support said production flowlines/risers, which method comprises the steps of: providing a workover riser to said well extending through the moonpool area; disposing a movable crane in a space above said moonpool area but below said top deck, said crane being moveable, particularly during normal operations, over at least some of said valve assembly stations and being supported on opposite sides of the moonpool opening; and, suspending from said crane means for applying tension to said workover riser, so as to tension and support said workover riser from said means.

14. A method according to claim 13 wherein said the means for applying tension comprises a plurality of tensioning cables, each of said cables having a lower end connected to said workover riser and an upper end connected to tensioning means for applying tension to said cable and hence to said workover riser.

15. A method of facilitating the performance of maintenance or repair work on an underwater well beneath a floating oil/gas production platform having a top deck, a main deck located below the top deck and defining a moonpool opening, a plurality of oil/gas production flowlines/risers extending between a plurality of underwater wells beneath said platform, and a plurality of adjacent valve assembly stations located in the moonpool area; disposing a movable crane in a space above said moonpool area but below said top deck, said crane being moveable, particularly during normal operations, over at least some of said valve assembly stations and being supported on opposite sides of the moonpool opening; equipping said crane with a plurality of pulleys over which pass a corresponding plurality of tensioning cables, each cable having a first end connected to said workover riser and a second end; connecting the second end of each cable to tensioning means for applying tension to said cable and hence to said workover riser, said tensioning means being positioned in an area peripheral to said station zone; and, tensioning and supporting said workover riser from said tensioning means via said cables.

* * * * *